US006782857B1

(12) United States Patent
Goshorn

(10) Patent No.: US 6,782,857 B1
(45) Date of Patent: Aug. 31, 2004

(54) RACE CAR VALVE LIFTER

(76) Inventor: Travis A. Goshorn, 17818 Stonebridge Rd., Spring Run, PA (US) 17262

( * ) Notice: Subject to any disclaimer, the term of this patent is extended or adjusted under 35 U.S.C. 154(b) by 0 days.

(21) Appl. No.: 10/330,758

(22) Filed: Dec. 30, 2002

(51) Int. Cl.[7] ..... F01L 1/14
(52) U.S. Cl. ..... 123/90.48; 123/90.55
(58) Field of Search ..... 123/90.48, 90.55, 123/90.57

(56) References Cited

U.S. PATENT DOCUMENTS

| | | | | |
|---|---|---|---|---|
| 3,200,801 A | * | 8/1965 | Dornbos | 123/90.51 |
| 4,228,771 A | * | 10/1980 | Krieg | 123/90.55 |
| 4,475,490 A | * | 10/1984 | Oono et al. | 123/90.52 |
| 5,007,388 A | * | 4/1991 | Seilenbinder | 123/90.55 |
| 5,239,951 A | | 8/1993 | Rao et al. | |
| 5,458,097 A | | 10/1995 | Devine et al. | |
| 5,746,167 A | | 5/1998 | Jesel | |
| 5,749,340 A | * | 5/1998 | Warburton et al. | 123/90.16 |
| 5,931,125 A | | 8/1999 | Valasopoulos | |
| 6,032,630 A | | 3/2000 | Yamamoto | |
| D440,837 S | | 4/2001 | Hart et al. | |

FOREIGN PATENT DOCUMENTS

| | | | | |
|---|---|---|---|---|
| FR | 06-1385850 | * | 12/1964 | 123/90.57 |
| GB | 584302 | * | 1/1946 | 123/90.57 |

* cited by examiner

*Primary Examiner*—Thomas Denion
*Assistant Examiner*—Zelalem Eshete

(57) ABSTRACT

A race car valve lifter for more reliable engine function for a race car. The race car valve lifter includes a tubular member having open first and second ends and a bore being disposed therethrough; and also includes a body being slidably disposed in the bore and through the open first end of the tubular member; and further includes a plug member being removably and securely disposed in the open second end of the tubular member; and also includes a spring member being disposed in the bore of the tubular member for biasing a portion of the body through the open first end of the tubular member.

4 Claims, 4 Drawing Sheets

RACE CAR VALVE LIFTER

BACKGROUND OF THE INVENTION

1. Field of the Invention

The present invention relates to valve lifters for race cars and more particularly pertains to a new race car valve lifter for more reliable engine function for a race car.

2. Description of the Prior Art

The use of valve lifters for race cars is known in the prior art. More specifically, valve lifters for race cars heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,458,097; U.S. Pat. No. 5,239,951; U.S. Pat. No. 5,746,167; U.S. Pat. No. 6,032,630; U.S. Pat. No. 5,931,125; and U.S. Pat. No. Des. 440,837.

While these devices fulfill their respective, particular objectives and requirements, the aforementioned patents do not disclose a new race car valve lifter. The prior art describes inventions having housings and pistons being biased by springs.

SUMMARY OF THE INVENTION

The general purpose of the present invention, which will be described subsequently in greater detail, is to provide a new race car valve lifter which has many of the advantages of the valve lifters for race cars mentioned heretofore and many novel features that result in a new race car valve lifter which is not anticipated, rendered obvious, suggested, or even implied by any of the prior art valve lifters for race cars, either alone or in any combination thereof. The present invention includes a tubular member having open first and second ends and a bore being disposed therethrough; and also includes a body being slidably disposed in the bore and through the open first end of the tubular member; and further includes a plug member being removably and securely disposed in the open second end of the tubular member; and also includes a spring member being disposed in the bore of the tubular member for biasing a portion of the body through the open first end of the tubular member. None of the prior art describes structure nor the combination of elements of the present invention.

There has thus been outlined, rather broadly, the more important features of the race car valve lifter in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new race car valve lifter which has many of the advantages of the valve lifters for race cars mentioned heretofore and many novel features that result in a new race car valve lifter which is not anticipated, rendered obvious, suggested, or even implied by any of the prior art valve lifters for race cars, either alone or in any combination thereof.

Still another object of the present invention is to provide a new race car valve lifter for more reliable engine function for a race car.

Still yet another object of the present invention is to provide a new race car valve lifter that prevents possible damage to the valve assembly.

Even still another object of the present invention is to provide a new race car valve lifter that is much more reliable than hydraulic valve lifters which tend to fail due to sticking and debris.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
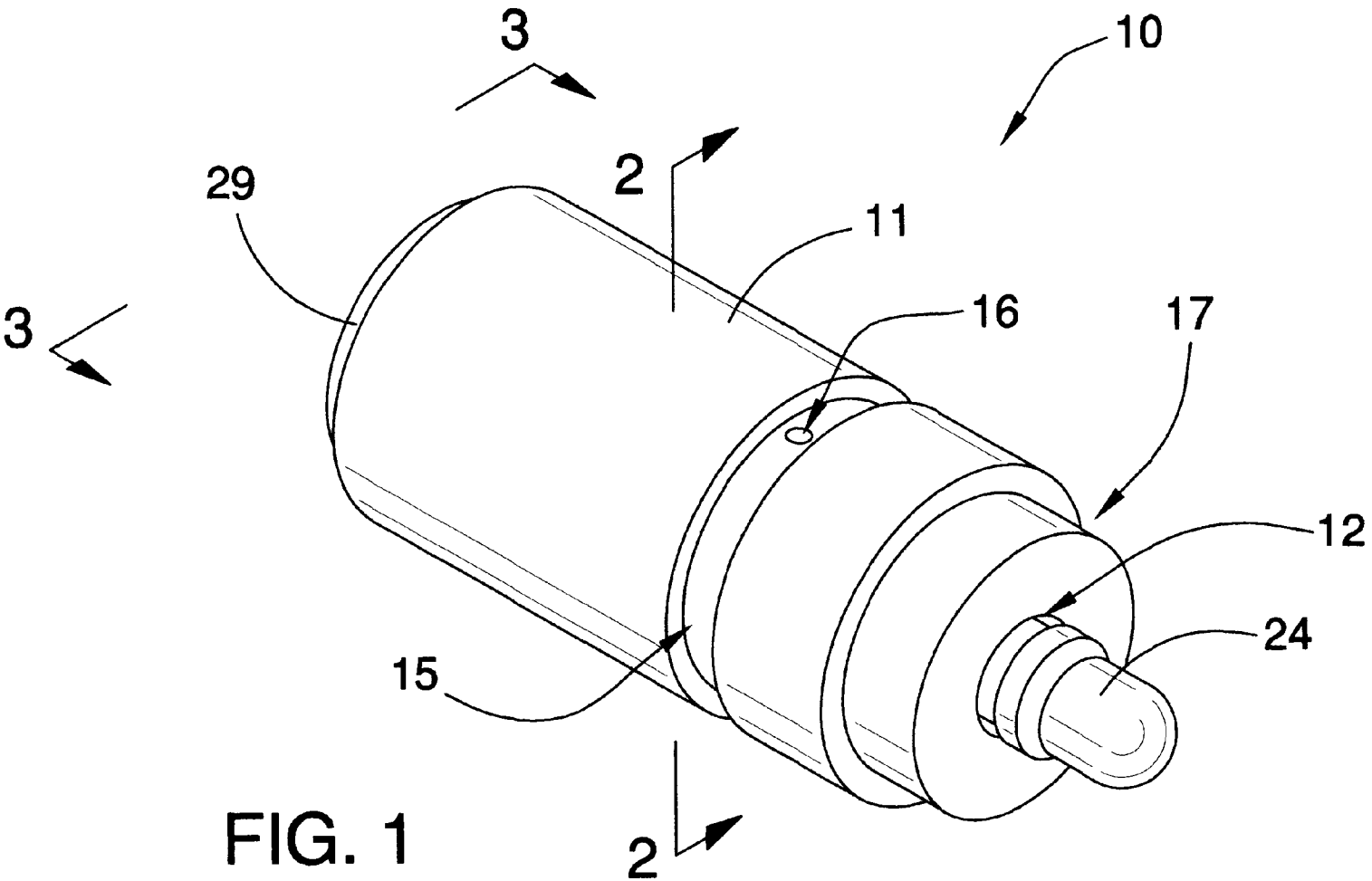
FIG. 1 is a perspective view of a new race car valve lifter according to the present invention.
Figure 2:
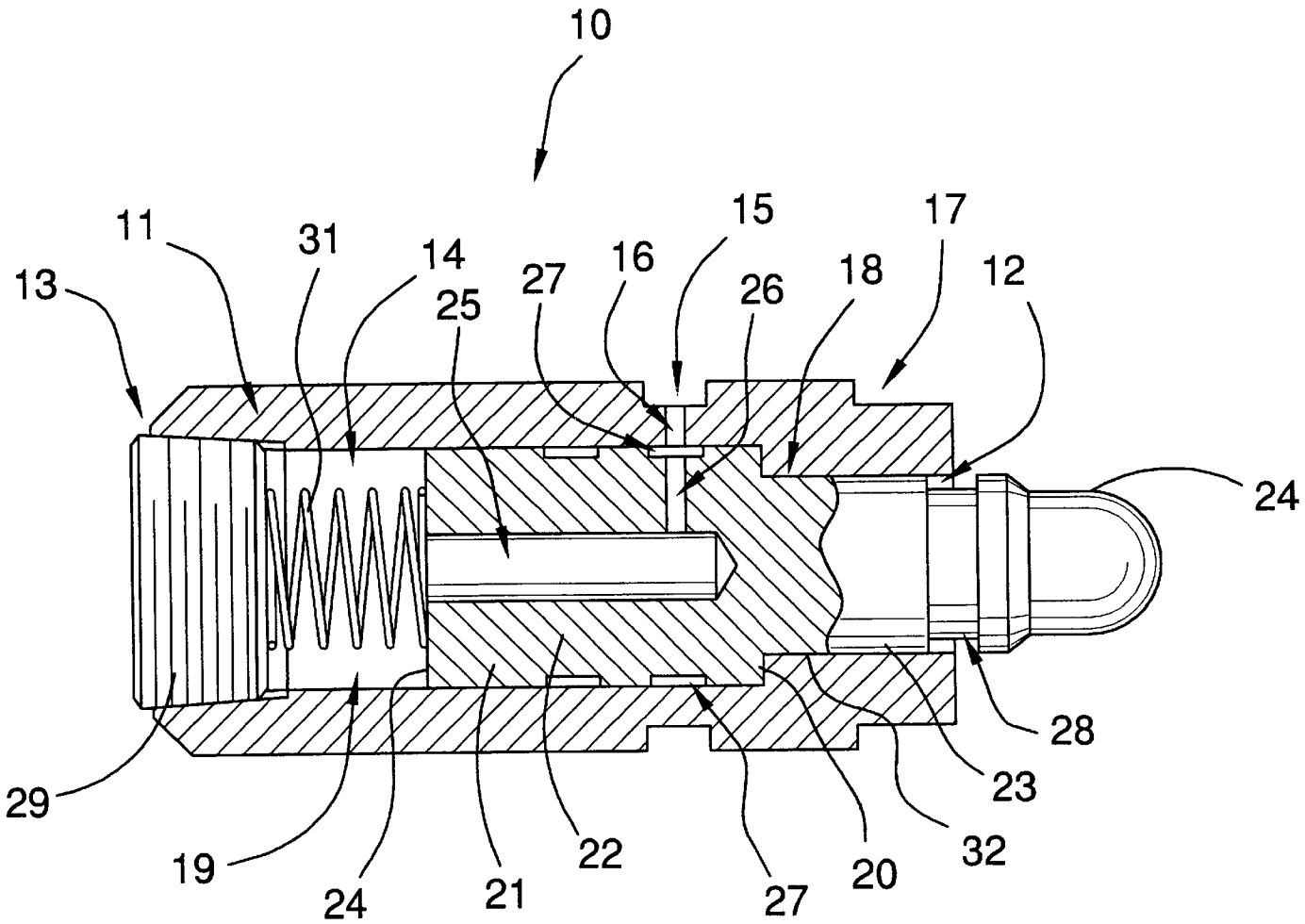
FIG. 2 is a cross-sectional view of the present invention.

With reference now to the drawings, and in particular to FIGS. 1 through 4 thereof, a new race car valve lifter embodying the principles and concepts of the present invention and generally designated by the reference numeral 10 will be described.

As best illustrated in FIGS. 1 through 4, the race car valve lifter 10 generally comprises a tubular member 11 having open first and second ends 12,13 and a bore 14 being disposed therethrough. The tubular member 11 has an annular groove 15 being disposed in an exterior of a wall thereof, and also has a hole 16 being disposed in the annular groove 15 and being extended into the bore 14 of the tubular member 11, and further has an annular recessed first end portion 17. The bore of the tubular member 14 has a front portion 18 and a back portion 19 having a greater circumference and diameter than that of the front portion 18 thus forming an annular ledge 20 adjoining the front and back portions 18,19 of the bore 14. The front portion 18 of the bore 14 has a diameter of approximately 0.510 inches, and the back portion 19 of the bore 14 has a diameter of approximately 0.625 inches.

The body 21 includes a cylindrical portion 22 having front and back ends and a first bore 25 being axially disposed therein through the back end thereof, and also includes a stem portion 23 being axially disposed at the front end of the cylindrical portion 22, and further includes a tip portion 24 being integrally attached at a first end of the stem portion 23. The body 21 further includes a first annular groove 27 being disposed in a front end portion of the cylindrical portion 22 and includes a second bore 26 being disposed in the first annular groove 27 and through a side wall of the cylindrical portion 22 and into the first bore 25, and also includes an annular groove portion 32 being disposed at the front end of the cylindrical portion 22, and further includes a second annular groove 28 being disposed in the stem portion 23 at the first end thereof. The tip portion 24 of the body 21 is parabolic-shaped.

Figure 3:
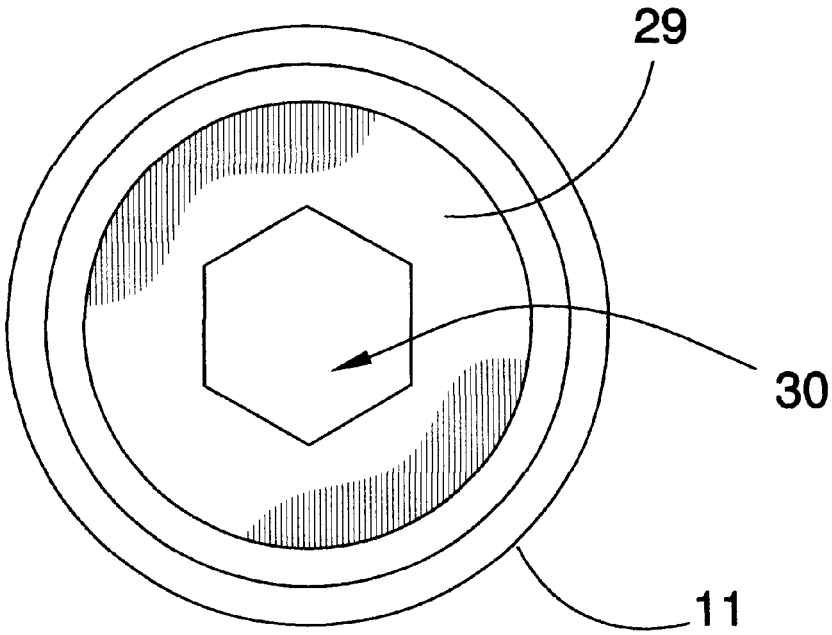
FIG. 3 is an end elevational view of the present invention.

As shown in FIG. 3, a plug member 29 is removably and securely disposed in the open second end 13 of the tubular member 11. The plug member 29 has a multi-side socket 30 being disposed in an end thereof and being adapted to receive a tool for inserting and removing the plug member 29 from the open second end 13 of the tubular member 11. The plug member 29 is threaded on a side thereof so that the plug member 29 can be threaded into the tubular member 11.

A spring member 31 is conventionally disposed in the bore 14 of the tubular member 11 for biasing the first end portion 23 of the body 21 through the open first end 12 of the tubular member 11. The spring member 31 is biasedly disposed between the body 21 and the plug member 29.

Figure 4:
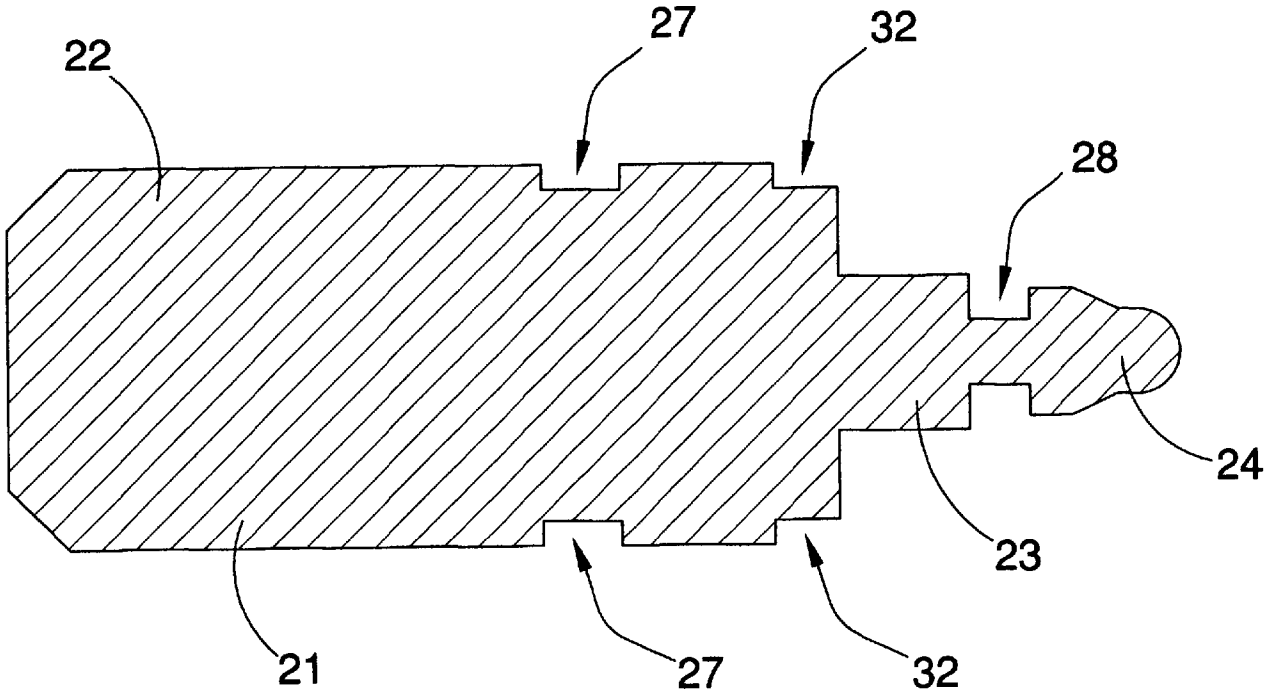
FIG. 4 is a cross-sectional view of another embodiment of the present invention.

As a second embodiment and shown in FIG. 4, the race car valve lifter 10 comprises the body 21 including a cylindrical portion 22 having a first end and a second end, and also including a stem portion 23 being axially and integrally attached to the first end of the cylindrical portion 22, and further including a tip portion 24 being integrally attached at an end of the stem portion 23. The cylindrical portion 22 has a chamfered second end portion, and also has a first end portion, and further has a first annular groove 27 being disposed in the first end portion, and also has an annular groove portion 32 at the first end of the cylindrical portion 22. The body 21 also includes a second annular groove 28 being disposed in the stem portion 23 at a first end thereof. The tip portion 24 has a parabolic-shaped end.

In use, the valve lifter 10 is disposed in the valve assembly of a racing car engine, and biases the valve in the engine.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the race car valve lifter. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A race car valve lifter comprising:

a tubular member having open first and second ends and a bore being disposed therethrough, said tubular member having an annular groove being disposed in an exterior of a wall thereof, and also having a hole being disposed in said annular groove and being extended into said bore of said tubular member, and further having an annular recessed first end portion, said bore of said tubular member having a front portion and a back portion having a greater circumference than that of said front portion thus forming an annular ledge adjoining said front and back portions of said bore;

a body being slidably disposed in said bore and through said open first end of said tubular member, said body including a cylindrical portion having front and back ends and a first bore being axially disposed therein through said back end thereof, and also including a stem portion being axially disposed at said front end of said cylindrical portion, and further including a tip portion being attached at a first end of said stem portion; said body further including a first annular groove being disposed in a front end portion of said cylindrical portion and including a second bore being disposed in said first annular groove and through a side wall of said cylindrical portion and into said first bore, and also including an annular recessed portion being disposed at said front end of said cylindrical portion, and further including a second annular groove being disposed in said stem portion at said first end thereof;

a plug member being removably and securely disposed in said open second end of said tubular member; and a spring member being disposed in said bore of said tubular member for biasing a portion of said body through said open first end of said tubular member.

2. A race car valve lifter as described in claim 1, wherein said tip portion is parabolic-shaped.

3. A race car valve lifter as described in claim 1, wherein said plug member has a multi-side socket being disposed in an end thereof and being adapted to receive a tool for inserting and removing said plug member from said open second end of said tubular member.

4. A race car valve lifter as described in claim 3, wherein said plug member is threaded about a side thereof so that said plug member can be threaded into said tubular member.

* * * * *